US012274410B2

(12) United States Patent
Qin et al.

(10) Patent No.: US 12,274,410 B2
(45) Date of Patent: Apr. 15, 2025

(54) CLEANER HANGER ASSEMBLY

(71) Applicant: Beijing Roborock Technology Co., Ltd., Beijing (CN)

(72) Inventors: Tao Qin, Beijing (CN); Liang Qiao, Beijing (CN); Peng Lei, Beijing (CN); Minghai Liu, Beijing (CN)

(73) Assignee: Beijing Roborock Technology Co., Ltd., Beijing (CN)

( * ) Notice: Subject to any disclaimer, the term of this patent is extended or adjusted under 35 U.S.C. 154(b) by 365 days.

(21) Appl. No.: 17/789,952

(22) PCT Filed: Oct. 19, 2020

(86) PCT No.: PCT/CN2020/121978

§ 371 (c)(1),
(2) Date: Jun. 29, 2022

(87) PCT Pub. No.: WO2021/135518

PCT Pub. Date: Jul. 8, 2021

(65) Prior Publication Data

US 2023/0030939 A1 Feb. 2, 2023

(30) Foreign Application Priority Data

Dec. 31, 2019 (CN) ..... 201911415864.9

(51) Int. Cl.
*A47L 9/00* (2006.01)
*A47L 9/28* (2006.01)

(52) U.S. Cl.
CPC ..... *A47L 9/0063* (2013.01); *A47L 9/2873* (2013.01)

(58) Field of Classification Search
CPC ..... A47L 9/0063; A47L 9/2873; A47L 9/00; A47L 5/24
See application file for complete search history.

(56) References Cited

U.S. PATENT DOCUMENTS 4,225,814 A * 9/1980 Gantz ..... H02J 7/02 D32/31
6,260,233 B1 7/2001 Wareham et al.
(Continued)

FOREIGN PATENT DOCUMENTS

CA 2378753 A1 2/2003
CN 205031171 U 2/2016
(Continued)

OTHER PUBLICATIONS

International Search Report issued in corresponding International Patent Application No. PCT/CN2020/121978 dated Jan. 18, 2021.
(Continued)

*Primary Examiner* — Stanton L Krycinski
(74) *Attorney, Agent, or Firm* — Morgan, Lewis & Bockius LLP

(57) ABSTRACT

The present disclosure provides, a cleaner hanger assembly, including a hanger, a charging bottom plate, an accessory frame, a hanger column and a base. The charging bottom plate can be used in cooperation with the hanger, so that a charging operation can be performed while the cleaner is hung on the hanger whether the cleaner is in a hanging state or in a floor-standing state, and the charging bottom plate can also be detached for separate use. The hanger can be connected to the accessory frame to form a wall hanger assembly; or the hanger can be connected to the base by means of the hanger column and the accessory frame is fixed in the middle of the hanger column to form a floor-standing hanger assembly.

10 Claims, 9 Drawing Sheets

(56) References Cited

U.S. PATENT DOCUMENTS

| | | | | |
|---|---|---|---|---|
| 6,557,206 | B1 * | 5/2003 | Liu | A47L 9/00 15/327.5 |
| 9,155,431 | B2 * | 10/2015 | Dyson | A47L 9/0063 |
| 9,271,618 | B2 * | 3/2016 | Mantyla | A47L 5/24 |
| 10,194,779 | B2 * | 2/2019 | Kim | A47L 9/2884 |
| 10,314,453 | B2 * | 6/2019 | Kim | A47L 9/28 |
| 10,405,717 | B2 * | 9/2019 | Kim | H01M 10/44 |
| 10,405,719 | B2 * | 9/2019 | Kim | A47L 5/24 |
| 10,561,291 | B2 * | 2/2020 | Kim | A47L 9/2873 |
| 10,610,075 | B2 * | 4/2020 | Kim | A47L 5/28 |
| 10,660,493 | B2 * | 5/2020 | Kim | H01M 10/46 |
| 10,842,335 | B2 * | 11/2020 | Hwang | A47L 9/0054 |
| 10,973,380 | B2 * | 4/2021 | Seo | A47L 11/202 |
| 11,502,523 | B2 * | 11/2022 | Ha | A47L 9/2884 |
| 11,583,156 | B2 * | 2/2023 | Lee | A47L 9/0063 |
| 11,992,171 | B2 * | 5/2024 | Seo | A47L 11/201 |
| 2019/0298135 | A1 | 10/2019 | Hwang et al. | |
| 2021/0000313 | A1 * | 1/2021 | Canning | A47L 9/0009 |
| 2021/0345848 | A1 * | 11/2021 | Jeon | A47L 9/0063 |

FOREIGN PATENT DOCUMENTS

| | | | |
|---|---|---|---|
| CN | 207118872 | U | 3/2018 |
| CN | 108599338 | A | 9/2018 |
| CN | 108695947 | A | 10/2018 |
| CN | 108836182 | A | 11/2018 |
| CN | 109222750 | A | 1/2019 |
| CN | 109512335 | A | 3/2019 |
| CN | 208573576 | U | 3/2019 |
| CN | 208640605 | U | 3/2019 |
| CN | 109602329 | A | 4/2019 |
| CN | 208910059 | U | 5/2019 |
| CN | 109953685 | A | 7/2019 |
| CN | 110025257 | A | 7/2019 |
| CN | 110115547 | A | 8/2019 |
| CN | 110974087 | A | 4/2020 |
| CN | 211270502 | U | 8/2020 |
| CN | 211796196 | U | 10/2020 |
| EP | 3456234 | A1 | 3/2019 |
| JP | 2019-187576 | A | 10/2019 |

OTHER PUBLICATIONS

Extended European Search Report issued in the corresponding Application No. 20909931.6, dated Apr. 15, 2024.

First Office Action issued in the corresponding CN Application No. 201911415864.9, dated Jun. 20, 2024.

* cited by examiner

CLEANER HANGER ASSEMBLY

CROSS-REFERENCE TO RELATED APPLICATION

This application is a U.S. National Stage of International Application No. PCT/CN2020/121978, filed on Oct. 19, 2020, which claims priority to Chinese Patent Application No. 201911415864.9, filed on Dec. 31, 2019, both of which are incorporated herein by reference in their entirety.

TECHNICAL FIELD

The present disclosure relates to a vacuum cleaner holder assembly, and specifically, to a versatile holder applicable to a handheld vacuum cleaner.

BACKGROUND

In existing vacuum cleaners, handheld vacuum cleaners, with relatively small sizes and convenience for use, have become increasingly popular among users who use the vacuum cleaners at home or on vehicles. Without limitations by wires, battery-powered wireless handheld vacuum cleaners, in particular, can be flexibly used to clean nooks. At present, handheld vacuum cleaners are widely used in domestic life. An existing handheld vacuum cleaner includes a main body, a dust collection channel, and a suction head. When in operation, the main body, the dust collection channel, and the suction head are assembled together, and after the operation, the main body, the dust collection channel, and the suction head are disassembled and stored away to save space. In this case, a holder is required to receive and store the disassembled components.

The following are several types of conventional handheld vacuum cleaner holders: The first type is an on-floor holder, and the on-floor holder stands on the ground as a placing space through a supporting base with a balance weight. The on-floor holder is not fixed and features high movability. For example, the Chinese utility model patent CN206473268U discloses a storage base for a handheld vacuum cleaner. The storage base includes a supporting base and a supporting pillar, wherein the supporting base is provided with a supporting surface and the supporting pillar is connected to the supporting base. An axis of the supporting pillar is located perpendicular to the supporting surface or tilts toward a center of the supporting surface. A holder for storing the handheld vacuum cleaner is located on the supporting pillar.

The second type is an on-wall holder, and the holder is fixedly mounted on a wall surface and is relatively advantageous in saving storage space with respect to the on-floor holder. For example, the Chinese patent No. CN102188189A discloses an on-wall holder that is a docking station. The docking station also has a function of charging. A machine body on which a dust cup is provided is clamped and attached to the on-wall holder with a relatively complex design such as an offset spring mechanism or the like.

Therefore, an on-wall charger that is for a vacuum cleaner and that takes up a relatively small space, has a simple structure, is applicable to various scenarios, and has relatively low manufacturing costs is urgently required.

SUMMARY

The present disclosure is aimed to provide a vacuum cleaner holder assembly.

Technical solutions of the present disclosure provide a vacuum cleaner holder assembly, including a holder, wherein the holder includes a holder substrate, and the holder substrate includes an upper part of the holder substrate and a lower part of the holder substrate. The upper part of the holder substrate and the lower part of the holder substrate each is provided with a holder hole that is configured to fix a versatile holder to a wall surface through a bolt. A pair of holder clasps are located on a surface of the upper part of the holder substrate and a surface of the lower part of the holder substrate, respectively. Each of two sides of the upper part of the holder substrate is connected to a holder side plate, and the holder side plate is located perpendicular to a plane on which the holder substrate is located.

Further, the holder side plate is provided with a holder engaging groove that extends in a direction of gravity on an inner surface of the holder side plate, an upper end of the holder engaging groove is opened and a lower end of the holder engaging groove is closed, a width of the upper end of the holder engaging groove is greater than a width of the lower end of the holder engaging groove, and the holder engaging groove is configured to hold a main body of a handheld vacuum cleaner in place and support the main body of the handheld vacuum cleaner when the versatile holder stands upright.

Further, an edge of a lower half of the lower part of the holder substrate is connected to a main body accommodation part, the main body accommodation part has a plate structure of arch that extends in a direction perpendicular to the plane in which the holder substrate is located, and an inward concave of the main body accommodation part is a main body accommodation cavity configured to support the main body of the handheld vacuum cleaner. An edge of an end of the main body accommodation part which is far from a position where the main body accommodation part is connected with the edge of the lower half of the lower part of the holder substrate is connected to a dust suction port accommodation part, the dust suction port accommodation part has a plate structure of arch which extends in the direction of gravity, an inward concave of the dust suction port accommodation part is a dust suction port accommodation cavity configured to accommodate a dust suction port of the main body of the handheld vacuum cleaner, and a diameter of the inward concave of the dust suction port accommodation part gradually decreases in the direction of gravity.

Further, a bottom part of an outward concave of the main body accommodation part is connected to a holder pillar upper accommodation slot, the holder pillar upper accommodation slot has a hollow pipe-like structure that extends in the direction of gravity, an inner part of the holder pillar upper accommodation slot matches a shape of a holder pillar, and a pair of holder pillar upper accommodation slot fixing holes, configured to fix a top end of the holder pillar inside the holder pillar upper accommodation slot through fixing bolts, are horizontally located on a back surface of the holder pillar upper accommodation slot.

Further, a front surface of the holder pillar upper accommodation slot and an outward concave of the dust suction port accommodation part are connected through a plurality of reinforced ribs. There are three reinforced ribs each of which is a rectangular plate structure and are located parallel to each other, and three edges of the reinforced ribs are connected to the outward concave of the dust suction port accommodation part, the outward concave of the main body accommodation part, and the front surface of the holder pillar upper accommodation slot.

Further, each of the outermost reinforced ribs of the plurality of reinforced ribs at left and right ends is connected to an accessory holder clasp accommodation slot, the accessory holder clasp accommodation slot has a hollow cuboid structure that opens vertically downward, and an accessory holder clasp fixing hole is located through a side wall of the accessory holder clasp accommodation slot and passes through the side wall.

Further, the vacuum cleaner holder assembly includes a charging substrate. The charging substrate includes a base and an upper cover that are connected to each other through a clasp-fitting. A pair of charging spring sheets are located at an upper end of the base, and a pair of charging holes that the charging spring sheets pass through and are exposed at a surface of the upper cover, are correspondingly located at an upper end of the upper cover. The base is provided with a charger connection port. Charging substrate slots configured for matching and engaging the holder clasps are correspondingly located on a back surface of the base, the base and the upper cover each include a rectangular upper part and a circular lower part that are integrated, and a lower-half circular part of the lower part of the base is a fitting part that has a diameter less than a diameter of an upper-half circular part of the lower part of the base. A flange is provided between the fitting part and the upper-half circular part of the lower part of the base and is configured to engage an edge of the main body accommodation part for positioning.

Further, the vacuum cleaner holder assembly includes an accessory holder. The accessory holder includes an accessory holder body, and the accessory holder body has a cross section of ellipse and is provided with a dust-collection component accommodation groove at a middle portion in a front surface of the accessory holder body. A plurality of open hanging grooves and closed hanging slots are located at regular intervals at two sides of the dust-collection component accommodation groove, and a holder pillar middle accommodation slot that passes through the accessory holder body is provided at a center of a top surface of the accessory holder body. A pair of accessory holder fixing holes that penetrate into the holder pillar middle accommodation slot are horizontally provided on a back surface of the accessory holder body, and each of the accessory holder fixing holes is provided with an accessory holder hole.

Further, an accessory holder clasp is located respectively at the two sides of the holder pillar middle accommodation slot, on a top surface of the accessory holder body, and the accessory holder clasps have an upright platy structure. A plurality of reinforced ribs are located at a position where the accessory holder clasp is connected to the top surface of the accessory holder body, and an accessory holder clasp hole is provided at a center of the accessory holder clasp.

Further, the vacuum cleaner holder assembly includes the holder pillar and a base. A holder pillar lower accommodation slot is located on a surface of the base, and a pair of holder pillar lower accommodation slot fixing holes that penetrate into the holder pillar lower accommodation slot are horizontally provided on a back surface of the holder pillar lower accommodation slot.

Further, the holder is configured in one of following manners: connecting to the accessory holder to form an on-wall holder combination; and connecting to the base through the holder pillar and fixing the accessory holder at a center of the holder pillar to form an on-floor holder combination.

It should be understood that the foregoing general descriptions and the detailed descriptions in the following are merely examples and explanations, and cannot be construed as a limitation to the present disclosure.

Figure 1:
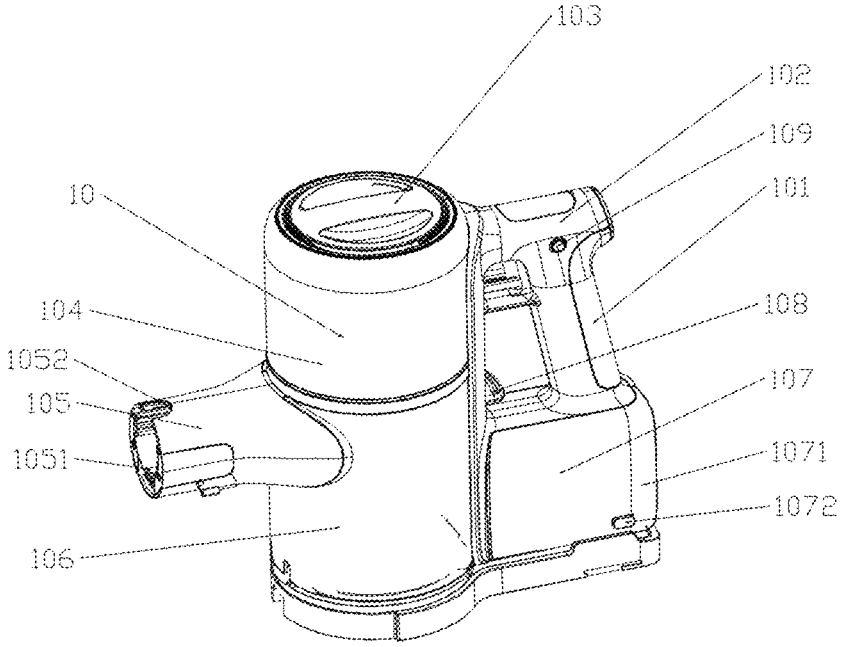
FIG. 1 illustrates a schematic diagram of an entire cleaner being directly charged on a desk by using a charging substrate according to the present disclosure.

10—main body, 101—handle, 102—connection part, 103—exhaust cover, 104—dust collection motor, 105—dust collection port, 1051—dust collection channel accommodation slot, 1052—dust collection channel fixing part, 106—dust cup, 107—battery pack, 1071—battery pack cover plate, 1072—main body main body clasp, 108—dust container cover lock, 109—locking button, 20—charging substrate, 201—base, 202—upper cover, 203—charging spring sheet, 204—flange, 205—fitting part, 206—side plate, 207—charging hole, 30—holder, 301—holder substrate, 302—holder hole, 303—holder side plate, 3031—holder engaging groove, 304—holder clasp, 305—main body accommodation part, 306—dust suction port accommodation part, 307—accessory holder clasp accommodation slot, 3071—accessory holder clasp fixing hole, 308—reinforced rib, 309—holder pillar upper accommodation slot, 310—holder pillar upper accommodation slot fixing hole, 311—holder hole, 40—accessory holder, 401—accommodation holder clasp, 4011—accessory holder clasp hole, 402—dust collection component accommodation groove, 403—open hanging groove, 404—holder pillar middle accommodation slot, 405—closed hanging slot, 406—accessory holder body, 407—accessory holder hole, 408—accessory holder fixing hole, 50—holder pillar, 60—base, 601—holder pillar lower accommodation slot, 602—holder pillar lower accommodation slot fixing hole, 70—dust suction pipe, and 80—dust suction head.

DESCRIPTION OF EMBODIMENTS

The following clearly describes technical solutions of the present disclosure with reference to the accompanying drawings. Clearly, the described embodiments are some but not all of embodiments of the present disclosure. All other embodiments obtained by one of ordinary skill in the art based on the embodiments of the present disclosure without creative efforts shall fall within the protection scope of the present disclosure.

In descriptions of the present disclosure, it should be noted that directions and position relationships indicated by terms "center/middle," "top/upper," "bottom/lower," "left," "right," "upright/vertical," "perpendicular/horizontal," "internal/inner," "external/outer," and the like are directions and position relationships illustrated in the accompanying drawings, and are merely for convenient and simplified description of the present disclosure, rather than for indicating or implying that an indicated apparatus or element has to have a specific direction, or be configured or operated in a specific direction. Therefore, this cannot be construed as a limitation on the present disclosure. In addition, terms "first," "second," and "third" are merely for description, but cannot be construed as indicating or implying relative importance.

In the descriptions of the present disclosure, it should be noted that terms the "mount," "join," and "connect" should be understood in a broad sense and, for example, may be fixed connection, demountable connection, or integrated connection; may be mechanical connection or electrical connection; or may be direct joint, indirect joint via an intermedium, or internal communication between two elements. For one of ordinary skill in the art, specific meanings of the foregoing terms in the present disclosure can be understood based on specific circumstances.

Although the foregoing handheld vacuum cleaner holders can implement a storage function, the on-floor holder takes a relatively large storage space, and a center of gravity is relatively high because the on-floor holder is removable, so that the on-floor holder still may fall down due to an external force and raises safety concerns. Although the existing on-wall holder resolves problems of the on-floor holder in storage space occupying and unsecure fixing, the on-wall holder is typically provided with a plurality of spring-locking pieces which are used to clamp a vacuum cleaner inside the on-wall holder, that is, a plurality of spring-locking pieces are used to clamp a handheld vacuum cleaner inside the on-wall holder. This causes a relatively complex structure of the on-wall holder, relatively high manufacturing costs, and a shortened service life due to frequent movements of the locking pieces.

It can be seen that the foregoing handheld vacuum cleaner holders clearly occupy a relatively large space or have a complex structure, inconvenience and have drawbacks of taking up a relatively large space, inconvenience, having a complex structure, and having a relatively short service life, so that improvement is required.

A conventional charging apparatus for a wireless handheld vacuum cleaner is classified into two types: an on-floor charging apparatus and an on-wall charging apparatus. A charging apparatus for a wireless handheld vacuum cleaner typically has a storage function. A conventional on-floor charging apparatus can be conveniently moved but takes up a relatively large space. The on-wall charger takes up a relatively small space, but a conventional on-wall charger usually has a relatively complex structure and relatively high manufacturing costs in order to hang a vacuum cleaner firmly onto a wall.

Embodiment 1: Referring to FIG. 1 to FIG. 12, a vacuum cleaner holder assembly includes a holder 30. The holder 30 includes a holder substrate 301, and the holder substrate 301 includes an upper part of the holder substrate and a lower part of the holder substrate, wherein the upper part of the holder substrate is rectangular and the lower part of the holder substrate is circular. The upper part of the holder substrate and the lower part of the holder substrate are integrated together. The upper part of the holder substrate and the lower part of the holder substrate each are provided with a holder hole 311 that is configured to hang a versatile holder onto a wall surface through a bolt. A pair of holder clasps 304 are located on each of a surface of the upper part of the holder substrate and a surface of the lower part of the holder substrate. Each of two side edges of the upper part of the holder substrate 301 is connected to a holder side plate 303, and the holder side plate 303 is located perpendicular to a plane in which the holder substrate 301 is located. A holder engaging groove 3031 that extends in a direction of gravity is provided on an inner surface of the holder side plate 303, an upper end of the holder engaging groove 3031 is open and a lower end of the holder engaging groove 3031 is closed, a width of the upper end of the holder engaging groove 3031 is greater than a width of the lower end, and the holder engaging groove 3031 is configured to position and support a main body of a handheld vacuum cleaner when the versatile holder stands upright.

Further, an edge of a lower half of the lower part of the holder substrate is connected to a main body accommodation part 305, the main body accommodation part 305 has a plate structure of arch that extends in a direction perpendicular to a plane in which the holder substrate 301 is located, and an inward concave cavity of the main body accommodation part 305 is a main body accommodation cavity configured to support the main body of the handheld vacuum cleaner. An edge of an end of the main body accommodation part 305, which is far from a connection position where the main body accommodation part is connected to the edge of the lower half of the lower part of the holder substrate, is connected to a dust suction port accommodation part 306; the dust suction port accommodation part 306 has a plate structure of arch that extends in the direction of gravity, an inward concave cavity of the dust suction port accommodation part 306 is a dust suction port accommodation cavity configured to receive a dust suction port of the main body of the handheld vacuum cleaner, and a diameter of the inward concave cavity of the dust suction port accommodation part 306 gradually decreases in the direction of gravity.

Further, a bottom part of an outward concave of the main body accommodation part 305 is connected to a holder pillar upper accommodation slot 309, the holder pillar upper accommodation slot 309 is a hollow pipe-like structure that extends in the direction of gravity, an inner part of the holder pillar upper accommodation slot conforms to a shape of a holder pillar, and a pair of holder pillar top accommodation slot fixing holes 310 are located horizontally on a back surface of the holder pillar upper accommodation slot 309 and are configured to fix a top of the holder pillar inside the holder pillar upper accommodation slot 309 through fixing bolts.

Further, a front surface of the holder pillar upper accommodation slot 309 and an outward concave of the dust suction port accommodation part 306 are connected by reinforced ribs 308. Three reinforced ribs 308, each with a rectangular platy structure, are located parallel to each other, and three edges of the reinforced ribs 308 are sequentially connected to the outward concave of the dust suction port accommodation part 306, the outward concave of the main body accommodation part 305, and a front surface of the holder pillar upper accommodation slot 309.

Further, an outer side of each of the two outermost reinforced ribs 308 is connected to an accessory holder clasp accommodation slot 307, the accessory holder clasp accommodation slot 307 has a hollow cuboid structure that opens vertically downward, and an accessory holder clasp fixing hole 3071 is provided, passing through a side wall of the accessory holder clasp accommodation slot 307.

Further, as illustrated in FIG. 1, the present disclosure further provides a vacuum cleaner main body 10. The vacuum cleaner main body 10 is cylindrical, an upper half of the vacuum cleaner main body 10 is a dust collection motor 104, a lower half of the vacuum cleaner main body 10 is a dust cup 106, and an exhaust cover 103 that can be dismounted by rotation is located on a top of the dust collection motor 104. A dust suction port 105 is perpendicularly located at an upper end of a side part of the dust cup 106, wherein the dust suction port 105 has a hollow pipe-like structure, and a dust collection pipe accommodation slot 1051 is located in the middle of the dust suction port 105. A dust collection pipe fixing part 1052 which is of a semicircular slot is located on the dust suction port 105 at an upper end of the dust collection pipe accommodation slot 1051. A battery pack 107 is perpendicularly located on another side part of the dust cup 106, wherein there is a battery pack cover plate 1071 coating the battery pack. Two main body clasps 1072 are located on two opposite surfaces at the rear of the battery pack 107, and are configured to match a holder engaging groove 3031 when the vacuum cleaner is placed onto the hanger, and a handle 101 is connected to an upper end of the battery pack 107, wherein the handle 101 is connected to an upper end of the dust collection motor 104 via a connection part 102, a locking button 109 is located on a front surface of the connection part 102, and a dust container cover lock 108, configured to open the cover of the dust cup 106, is located on a side surface of the dust cup 106 that corresponds to the handle 101.

Figure 7:
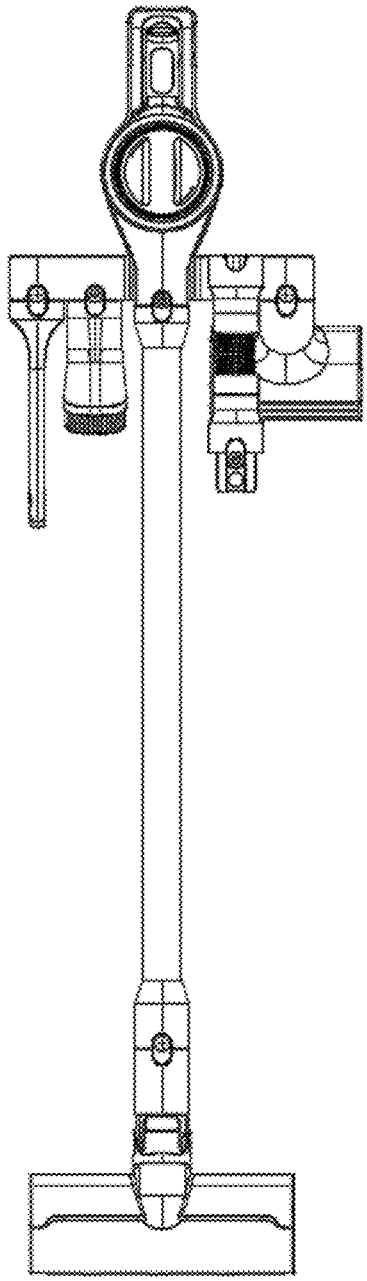
FIG. 7 illustrates a front view of an on-wall holder with an entire cleaner and an accessory holder according to the present disclosure.
Figure 11:
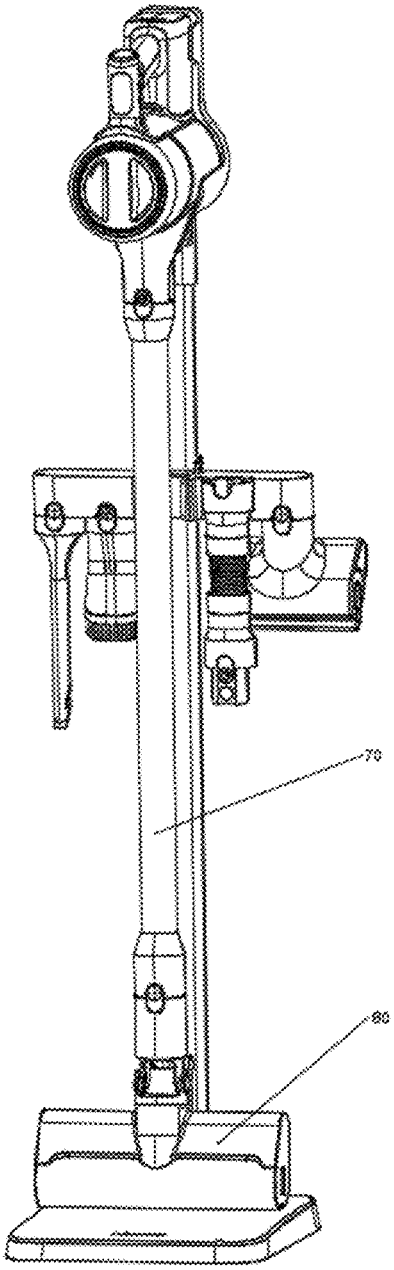
FIG. 11 illustrates a front view of an on-floor holder with an entire cleaner, a holder pillar, and an accessory holder according to the present disclosure.
Figure 12:
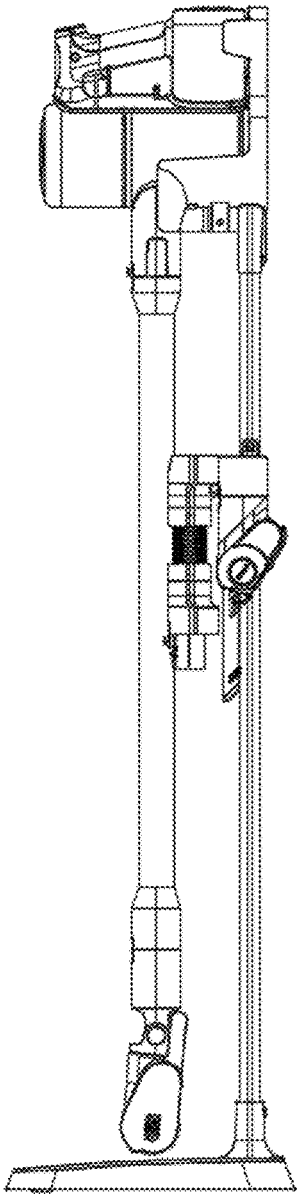
FIG. 12 illustrates a lateral view of an on-floor holder with an entire cleaner, a holder pillar, and an accessory holder according to the present disclosure, where.

Further, as illustrated in FIG. 7 and FIG. 11, a vacuum cleaner may be equipped with a plurality of vacuum cleaner accessories. The vacuum cleaner accessories may include another vacuum cleaner head (for example, a dedicated nozzle for bedding), a flat suction head, a brush accessory, and the like that may be fixed on a right side of an accessory holder. A roller brush of the vacuum cleaner head is a floor brush, and a roller brush of the dedicated head for bedding is a carpet brush. The flat head accessory may be a long flat head, or the flat head accessory may be a short flat head, and the flat head accessory is fixed on a left side of the accessory holder. The brush accessory may be a hair brush head that is fixed on the left side of the accessory holder. In addition, a vacuum cleaner accessory may further include a pet brush, another head, or a sweeping accessory. All the accessories can be stored on the accessory holder 40.

Figure 2:
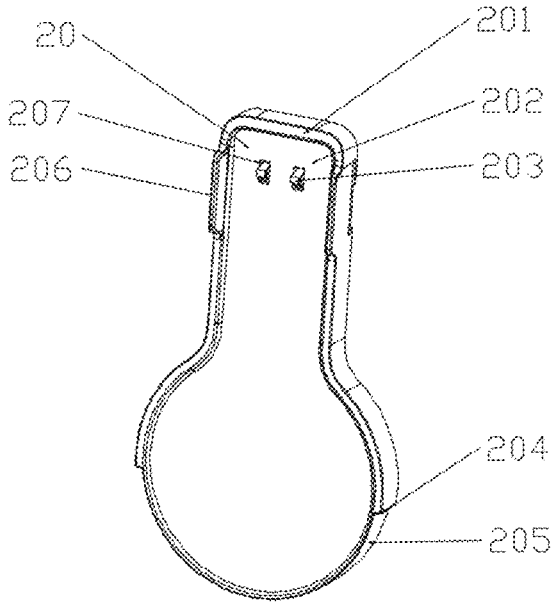
FIG. 2 illustrates a schematic structural diagram of a charging substrate according to the present disclosure.
Figure 3:
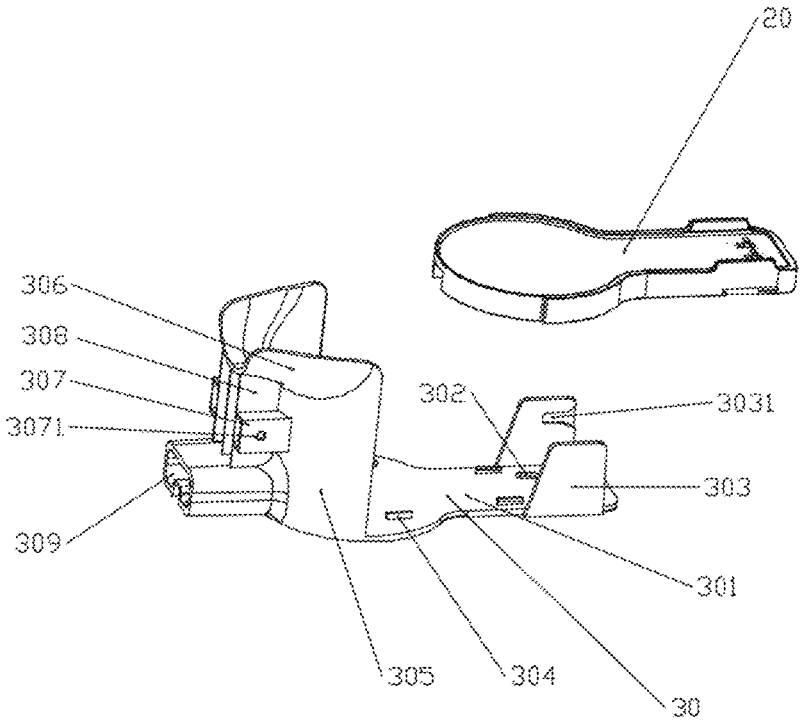
FIG. 3 illustrates a schematic diagram of a charging substrate being separate from a holder according to the present disclosure.
Figure 4:
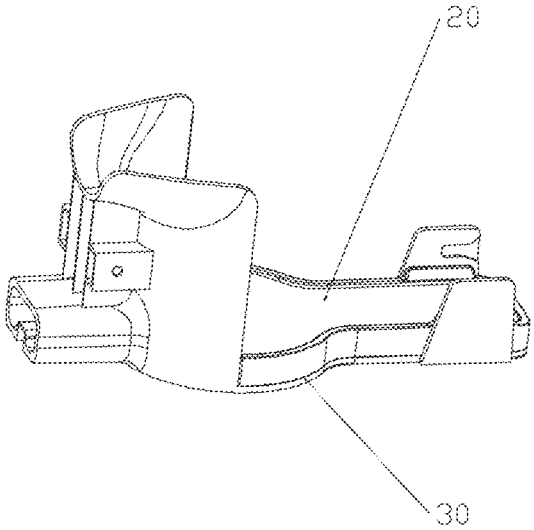
FIG. 4 illustrates a schematic diagram of a charging substrate being clasped on a holder according to the present disclosure.

Further, as illustrated in FIG. 2 to FIG. 4, a charging substrate 20 is further included. The charging substrate 20 includes a base 201 and an upper cover 202 that can be connected to one another through clasp-fitting. A pair of charging spring sheets 203 are located at an upper end of the base 201, and a pair of charging holes 207 that is suitable for the charging spring sheets 203 to pass through to be exposed at a surface of the upper cover 202 are correspondingly located at an upper end of the upper cover 202. A charger connection port is located on the base 201. A charging substrate slot configured to match and engage the holder clasps 304 are correspondingly located on a back surface of the base 201, the base 201 and the upper cover 202 each include a rectangular upper part and a circular lower part that are integrated together, and a lower semicircle of the lower part of the base 201 is a fitting part 205 that has a diameter less than a diameter of an upper semicircle. There is a flange 204 between the fitting part 205 and the upper semicircle of the lower part of the base 201, and the flange 204 is configured for fixedly clamping an edge of the main body accommodation part 305.

Figure 5:
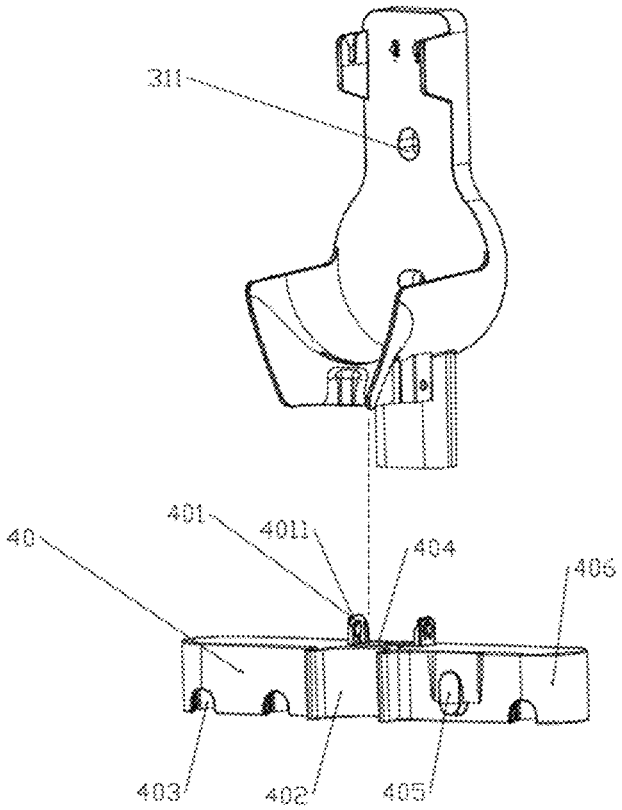
FIG. 5 illustrates a schematic diagram of a holder being separate from an accessory holder according to the present disclosure.
Figure 6:
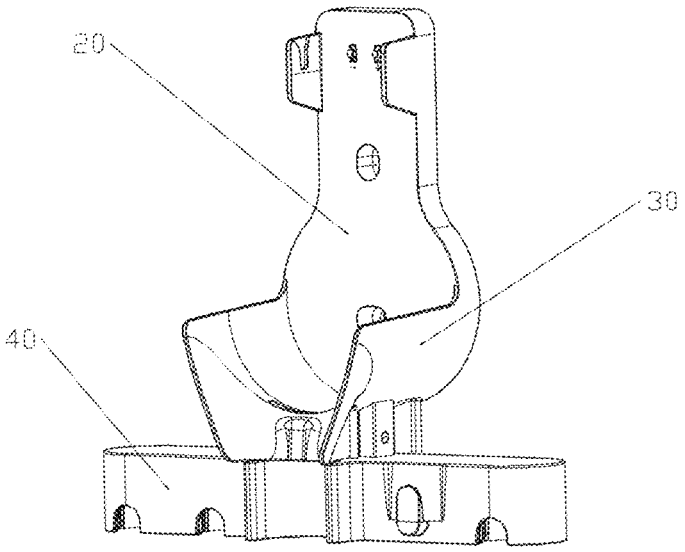
FIG. 6 illustrates a schematic diagram of a holder being connected to an accessory holder according to the present disclosure.

Further, as illustrated in FIG. 5 and FIG. 6, the accessory holder 40 is included. The accessory holder 40 includes an accessory holder body 406, and the accessory holder body 406 has an elliptic intersecting surface and is provided with a dust collection component accommodation groove 402 in a front center of the accessory holder body. Several open hanging grooves 403 and closed hanging slots 405 are located at regular intervals at two sides of the dust collection component accommodation groove 402, and a holder pillar middle accommodation slot 404 that passes through the accessory holder body is provided at a center of a top surface of the accessory holder body 406. A pair of accessory holder fixing holes 408 that pass through into the holder pillar middle accommodation slot 404 are horizontally provided on a back surface of the accessory holder body 406, and each of the accessory holder fixing holes 408 is provided with an accessory holder hole 407.

Further, an accessory holder clasp 401 is located on a top surface of the accessory hold body 406 and at respective sides of the holder pillar middle accommodation slot 404, and the accessory holder clasp 401 has a plate structure and is located perpendicular to the top surface of the accessory hold body 406. Several reinforced ribs are located at a position where the accessory holder clasp 401 is connected to the top surface of the accessory holder body 406, and an accessory holder clasp hole 4011 is provided at a center of the accessory holder clasp 401.

Further, as illustrated in FIG. 9 to FIG. 12, a holder pillar 50 and a base 60 are included. A holder pillar lower accommodation slot 601 is located on a surface of the base 60, and a pair of holder pillar lower accommodation slot fixing holes 602 are horizontally provided on a back surface of the holder pillar lower accommodation slot 601 and pass through into the holder pillar lower accommodation slot 601.

Figure 8:
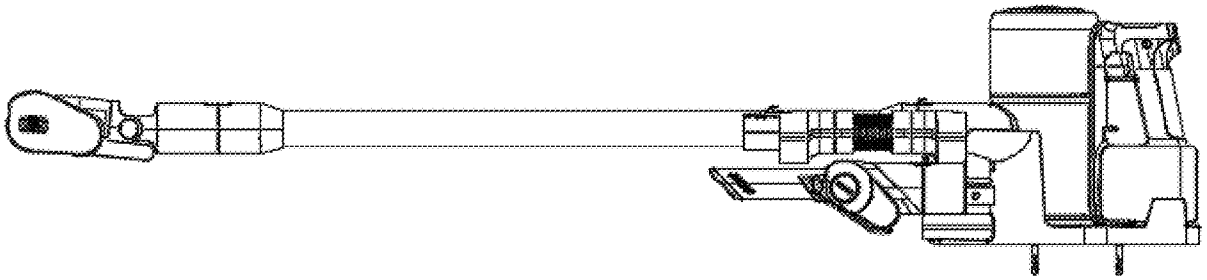
FIG. 8 illustrates a lateral view of an on-wall holder with an entire cleaner and an accessory holder according to the present disclosure.
Figure 9:
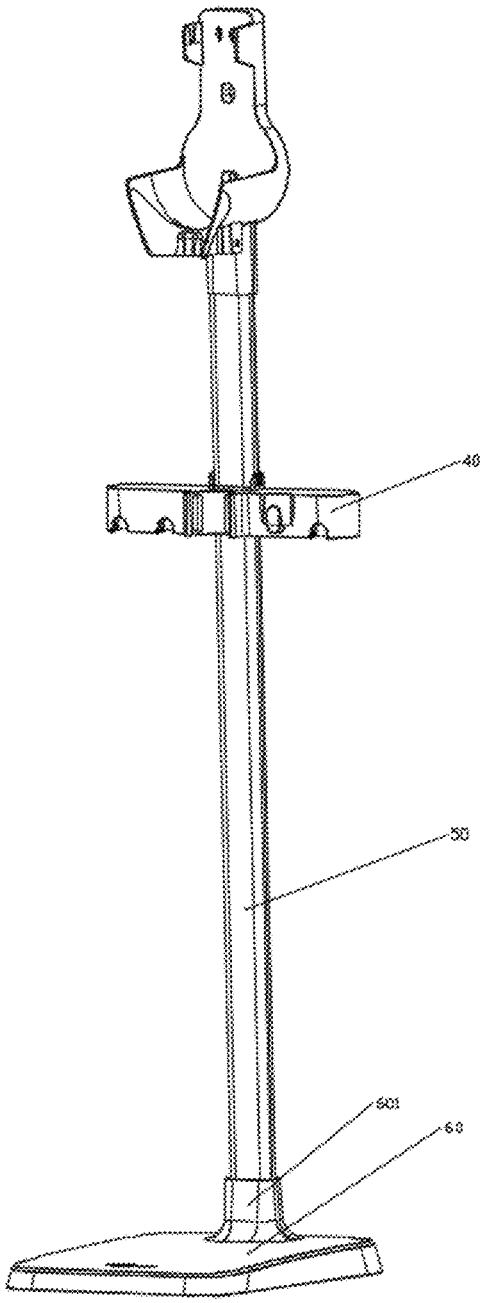
FIG. 9 illustrates a schematic frontal diagram of an on-floor holder with a holder pillar and an accessory holder according to the present disclosure.
Figure 10:
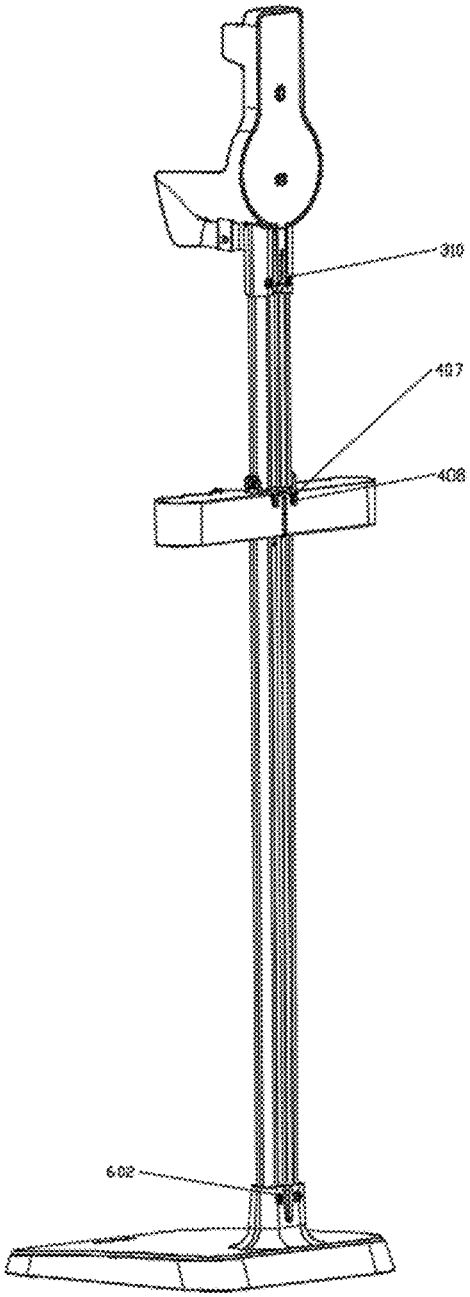
FIG. 10 illustrates a schematic rear diagram of an on-floor holder with a holder pillar and an accessory holder according to the present disclosure.

Further, the holder 30 may be connected to the accessory holder 40 to form an on-wall holder combination, which is as illustrated in FIG. 7 and FIG. 8; or the holder 30 may be connected to the base 60 through the holder pillar 50 and fix the accessory holder 40 at a center of the holder pillar 50 to form an on-floor holder combination, which is as illustrated in FIG. 9 to FIG. 12.

Compared with the conventional technology, the present disclosure has the following beneficial effects:

1. The charging substrate may be used with the holder, so that when a vacuum cleaner is in a wall-mounted state or a floor-standing state, the vacuum cleaner can be charged by hanging onto the holder; or the charging substrate and the holder may be dismounted and separately used, so that the main body of the vacuum cleaner is attached to the charging substrate and is placed on a plane for direct charging.

2. A stiffening structure is located for a main stress-receiving arch outward concave on an outer wall of the main body accommodation part, thereby improving the overall strength of the outer wall of the main body accommodation part.

3. The holder may be connected to the accessory holder by using the accessory holder clasp to form a wall-mounted holder combination; or may be connected to the base by using the holder pole to form a floor holder combination. There are various manners of connecting accessories and flexible manners of combining that can be applied to a plurality of storage scenarios.

4. The holder is located with the main body accommodation part and the dust collection nozzle accommodation part that are used with the main body of the vacuum cleaner. The main body accommodation part and the dust collection nozzle accommodation part each have a simple structure and high suitability, so that there is no need for frequent fastening.

5. The main body of the vacuum cleaner is placed onto the holder by hanging main body clasps on the holder engaging groove of the holder. Structures are simple and stress receiving is even, so that taking off and putting on are convenient.

6. The accessory holder may be connected to the holder, may be connected to the holder pole, or may be independently fixed onto a wall surface. There are wide applications and flexible manners of fixing.

7. The main body of the vacuum cleaner is used with the holder engaging groove on the holder matching the main body clasps, so that the main body of the vacuum cleaner can precisely be held in place in both of the wall-mounted holder combination and the floor holder combination, and the main body can make, based on gravity of the main body, a charging contact of the main body fully connected to the charging spring sheets on the holder after the main body is hung onto the holder, thereby achieving good charging effects.

The foregoing embodiments are illustrative embodiments of the present disclosure, but implementations of the present disclosure are not limited to the foregoing embodiments. Any other variations, modifications, replacements, combinations, simplifications without departing from a principle of the present disclosure should be equivalent displacements and fall into the protection scope of the present disclosure.

What is claimed is:

1. A vacuum cleaner holder assembly, comprising a holder, wherein the holder comprises a holder substrate, the holder substrate comprises an upper part of the holder substrate and a lower part of the holder substrate, and each of the upper part of the holder substrate and the lower part of the holder substrate is provided with a holder hole that is configured to fix the holder to a wall through a bolt; a pair of holder clasps are located on a surface of the upper part of the holder substrate and a surface of the lower part of the holder substrate, respectively; and each of two sides of the upper part of the holder substrate is connected to a holder side plate, and the holder side plate is located perpendicular to a plane on which the holder substrate is located.

2. The vacuum cleaner holder assembly according to claim 1, wherein the holder side plate is provided with a holder engaging groove that extends in a direction of gravity on an inner surface of the holder side plate, an upper end of the holder engaging groove is opened and a lower end of the holder engaging groove is closed, a width of the upper end of the holder engaging groove is greater than a width of the lower end of the holder engaging groove, and the holder engaging groove is configured to hold a main body of a handheld vacuum cleaner in place and support the main body of the handheld vacuum cleaner when the holder stands upright.

3. The vacuum cleaner holder assembly according to claim 2, wherein an edge of a lower half of the lower part of the holder substrate is connected to a main body accommodation part, the main body accommodation part has a plate structure of arch that extends in a direction perpendicular to the plane in which the holder substrate is located, and an inward concave of the main body accommodation part is a main body accommodation cavity configured to support the main body of the handheld vacuum cleaner; and an edge of an end of the main body accommodation part which is away from a position where the main body accommodation part is connected with the edge of the lower half of the lower part of the holder substrate is connected to a dust suction port accommodation part, the dust suction port accommodation part has a plate structure of arch that extends along the direction of gravity, an inward concave of the dust suction port accommodation part is a dust suction port accommodation cavity configured to accommodate a dust suction port of the main body of the handheld vacuum cleaner, and a diameter of the inward concave of the dust suction port accommodation part gradually decreases along the direction of gravity.

4. The vacuum cleaner holder assembly according to claim 3, wherein a bottom part of an outward concave of the main body accommodation part is connected to a holder pillar upper accommodation slot, the holder pillar upper accommodation slot is a hollow pipe structure that extends in the direction of gravity, an inner part of the holder pillar upper accommodation slot matches a shape of a holder pillar, and a pair of holder pillar upper accommodation slot fixing holes, configured to fix a top end of the holder pillar inside the holder pillar upper accommodation slot through fixing bolts, are horizontally located on a back surface of the holder pillar upper accommodation slot.

5. The vacuum cleaner holder assembly according to claim 4, wherein a front surface of the holder pillar upper accommodation slot and an outward concave of the dust suction port accommodation part are connected by a plurality of reinforced ribs, there are three reinforced ribs, each of which is a rectangular plate structure, that are located parallel to each other, and three edges of the reinforced ribs are sequentially connected to the outward concave of the dust suction port accommodation part, the outward concave of the main body accommodation part, and the front surface of the holder pillar upper accommodation slot.

6. The vacuum cleaner holder assembly according to claim 5, wherein each of the outermost reinforced ribs of the plurality of reinforced ribs at left and right ends is connected to an accessory holder clasp accommodation slot, the accessory holder clasp accommodation slot is a hollow cuboid structure that opens vertically downward, and an accessory holder clasp fixing hole is located through a side wall of the accessory holder clasp accommodation slot and passes through the side wall.

7. The vacuum cleaner holder assembly according to claim 6, further comprising a charging substrate, wherein the charging substrate comprises a base and an upper cover that can be connected to one another through clasp-fitting, a pair of charging spring sheets are located at an upper end of the base, a pair of charging holes that the charging spring sheets pass through and are exposed at a surface of the upper cover are correspondingly located at an upper end of the upper cover, and the base is provided with a charger connection port; and charging substrate slots configured to match and engage the holder clasps are correspondingly located on a back surface of the base, the base and the upper cover each comprise a rectangular upper part and a circular lower part that are integrated together, a lower semicircle of the lower part of the base is a fitting part that has a diameter less than a diameter of an upper semicircle of the lower part of the base, a flange is provided between the fitting part and the upper semicircle of the lower part of the base, and is configured to engage an edge of the main body accommodation part for positioning.

8. The vacuum cleaner holder assembly according to claim 7, further comprising an accessory holder, wherein the accessory holder comprises an accessory holder body, the accessory holder body has a cross section of ellipse and is provided with a dust collection component accommodation groove at a middle portion of a front surface of the accessory holder body, a plurality of open hanging grooves and a plurality of closed hanging slots are located at regular intervals at two sides of the dust collection component accommodation groove, a holder pillar middle accommodation slot that passes through the accessory holder body is provided at a center of a top surface center of the accessory holder body, a pair of accessory holder fixing holes that penetrate into the holder pillar middle accommodation slot are horizontally provided on a back surface of the accessory holder body, each of the accessory holder fixing holes is provided with an accessory holder hole, an accessory holder clasp is located respectively at both sides of the holder pillar middle accommodation slot that are on a top surface of the accessory holder body, the accessory holder clasp has an upright platy structure, a plurality of reinforced ribs are located at a position where the accessory holder clasp is connected to the top surface of the accessory holder body, and an accessory holder clasp hole is provided at a center of the accessory holder clasp.

9. The vacuum cleaner holder assembly according to claim 8, further comprising the holder pillar and a base, a holder pillar lower accommodation slot is provided on a surface of the base, and a pair of holder pillar lower accommodation slot fixing holes that penetrate into the holder pillar lower accommodation slot are horizontally provided on a back surface of the holder pillar lower accommodation slot.

10. The vacuum cleaner holder assembly according to claim 9, wherein the holder is connected to the accessory holder to form an on-wall holder combination; or the holder is connected to the base through the holder pillar and the accessory holder is fixed at a center of the holder pillar to form an on-floor holder combination.

* * * * *